United States Patent [19]

Davies

[11] Patent Number: 4,866,794

[45] Date of Patent: Sep. 19, 1989

[54] PORTABLE SHOWER

[76] Inventor: Roy O. Davies, 4200 West Middle Rd., Peoria, Ill. 61605

[21] Appl. No.: 216,213

[22] Filed: Jul. 7, 1988

[51] Int. Cl.[4] ..... A47K 3/23

[52] U.S. Cl. ..... 4/599; 4/602

[58] Field of Search ..... 4/599, 602, 603, 616, 4/617

[56] References Cited

U.S. PATENT DOCUMENTS

| | | | |
|---|---|---|---|
| 8,421 | 10/1851 | Brown | 4/599 |
| 283,117 | 8/1883 | Kendell | 4/602 |
| 1,049,714 | 1/1913 | Herscovitz | 4/602 |
| 1,450,218 | 4/1923 | Nenoff | 4/599 |
| 1,844,038 | 2/1932 | Hooker | 4/599 |
| 3,629,875 | 12/1971 | Dow et al. | 4/599 |
| 3,681,788 | 8/1972 | Le Blanc et al. | 4/602 |
| 4,170,795 | 10/1979 | Hahn | 4/599 |

FOREIGN PATENT DOCUMENTS

| | | | |
|---|---|---|---|
| 954255 | 12/1949 | France | 4/602 |

*Primary Examiner*—Charles E. Phillips

*Attorney, Agent, or Firm*—Leon Gilden

[57] ABSTRACT

A portable shower is constructed from a collapsible flexible material and is designed to be suspended from an overhead support when being utilized. The shower carrying case also functions as a water delivery container during periods of use.

1 Claim, 4 Drawing Sheets

PORTABLE SHOWER

BACKGROUND OF THE INVENTION

1. Field of the Invention

The present invention relates to showers, and more particularly pertains to a new and improved portable shower which may be compactly stored and transported in a small carrying case during periods of non-use.

2. Description of the Prior Art

Portable showers are well known in the prior art, and in this respect, numerous variations of these devices have been patented over the years. Due to the complexities of construction and high manufacturing costs associated with these various patented models of portable showers, apparently little or no commercial success has been achieved.

A good representative example of an early portable shower is to be found in U.S. Pat. No. 283,117 which issued to W. Kendall on Aug. 14, 1883. The Kendall shower utilizes a rigid frame structure with flexible side curtains being suspended therefrom. An overhead container retains a supply of water which may be selectively delivered to the bather. A less cumbersome portable shower is illustrated in U.S. Pat. No. 1,049,714 which issued to M. Herscovitz on Jan. 7, 1913. The shower illustrated in this patent may be collapsed into a compact storage pouch, and a rigid support structure may be assembled to retain the flexible curtain portion of the shower in its operable position. The support structure also retains a water holding container along a top portion thereof.

Another portable shower apparatus utilizing a support structure that may be selectively assembled to hold a flexible curtain portion is shown in U.S. Pat. No. 1,844,038 which issued to B. Hooker on Feb. 9, 1932. This structure is similar to the aforementioned Herscovitz shower, and the apparatus is further provided with a carrying case for the disassembled shower during periods of non-use.

At least one patent discloses a portable shower arrangement that dispenses with a rigid support structure to which a flexible collapsible shower curtain is attached. In this respect, U.S. Pat. No. 1,450,218, which issued to C. Nenoff on Apr. 3, 1923, discloses a flexible shower curtain assembly designed to be suspended by ropes from a pre-existing overhead structure. While being functional for its intended use, the portable shower shown in this patent makes no provision for a water delivery container, nor is it particularly adapted for collapsible storage in a carrying case. As such, the Nenoff portable shower has apparently met with little or no commercial success.

The above-discussed portable showers are representative of a far larger number of portable showers which have been patented and all of which are apparently not presently commercially available for various reasons. As above mentioned, the various complexities of design have contributed to high manufacturing costs which most likely accounts for lack of commercial success. Further, the large number of available patents relating to portable showers is illustrative of the continuing need for minor improvements in a crowded art whereby such improvements could finally effect the delivery of a portable shower assembly to the public at a reasonable cost. As such, a continuing need for further improvements in the art is apparent wherein such improvements would involve the simplifying of prior art constructions, thereby to reduce manufacturing complexities and expenses, and in this respect, the present invention addresses this need.

SUMMARY OF THE INVENTION

In view of the foregoing disadvantages inherent in the known types of portable showers now present in the prior art, the present invention provides an improved portable shower construction wherein the substantial manufacturing complexities and expenses associated with the prior art devices are effectively eliminated, thereby making feasible the commercial exploitation of such showers. As such, the general purpose of the present invention, which will be described subsequently in greater detail, is to provide a new and improved portable shower which has all the advantages of the prior art portable showers and none of the disadvantages.

To attain this, the present invention includes a flexible shower curtain which may be shaped into a cylinder by the insertion of four curved rod members in a top seam thereof. The four rod members are joined together to form a two foot wide circle, thus to give the shower assembly the desired cylindrical shape, and a zippered door facilitates access into the shower. Support rings positioned along a top edge of the shower allow the same to be suspended from several lines which join together at an apex, and a single rope may then be fastened to the apex of the support lines to effect a suspension of the shower assembly from a pre-existing support structure, such as a tree limb or the like. A carrying case associated with the invention has a portion thereof formed as a shower head with an appropriate control valve, and the handle of the carrying case permits the same to the suspended above the shower assembly. The carrying case is filled with water and thus functions as the water supply for the shower. In a modified embodiment of the invention, the shower head may be exchanged for a flexible tube assembly having a hand held shower nozzle attached thereto, and in this construction, the water carrying container does not necessarily have to be suspended directly above the flexible shower curtain per se.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable shower which has all the advantages of the prior art portable showers and none of the disadvantages.

It is another object of the present invention to provide a new and improved portable shower which may be easily and efficiently manufactured and marketed.

It is a further object of the present invention to provide a new and improved portable shower which is of a durable and reliable construction.

An even further object of the present invention is to provide a new and improved portable shower which is susceptible of a low cost of manufacture with regard to both materials and labor, and which accordingly is then susceptible of low prices of sale to the consuming public, thereby making such portable showers economically available to the buying public.

Still yet another object of the present invention is to provide a new and improved portable shower which provides in the apparatuses and methods of the prior art some of the advantages thereof, while simultaneously overcoming some of the disadvantages normally associated therewith.

Still another object of the present invention is to provide a new and improved portable shower which includes the use of a carrying case that also functions as a water holding and delivery container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
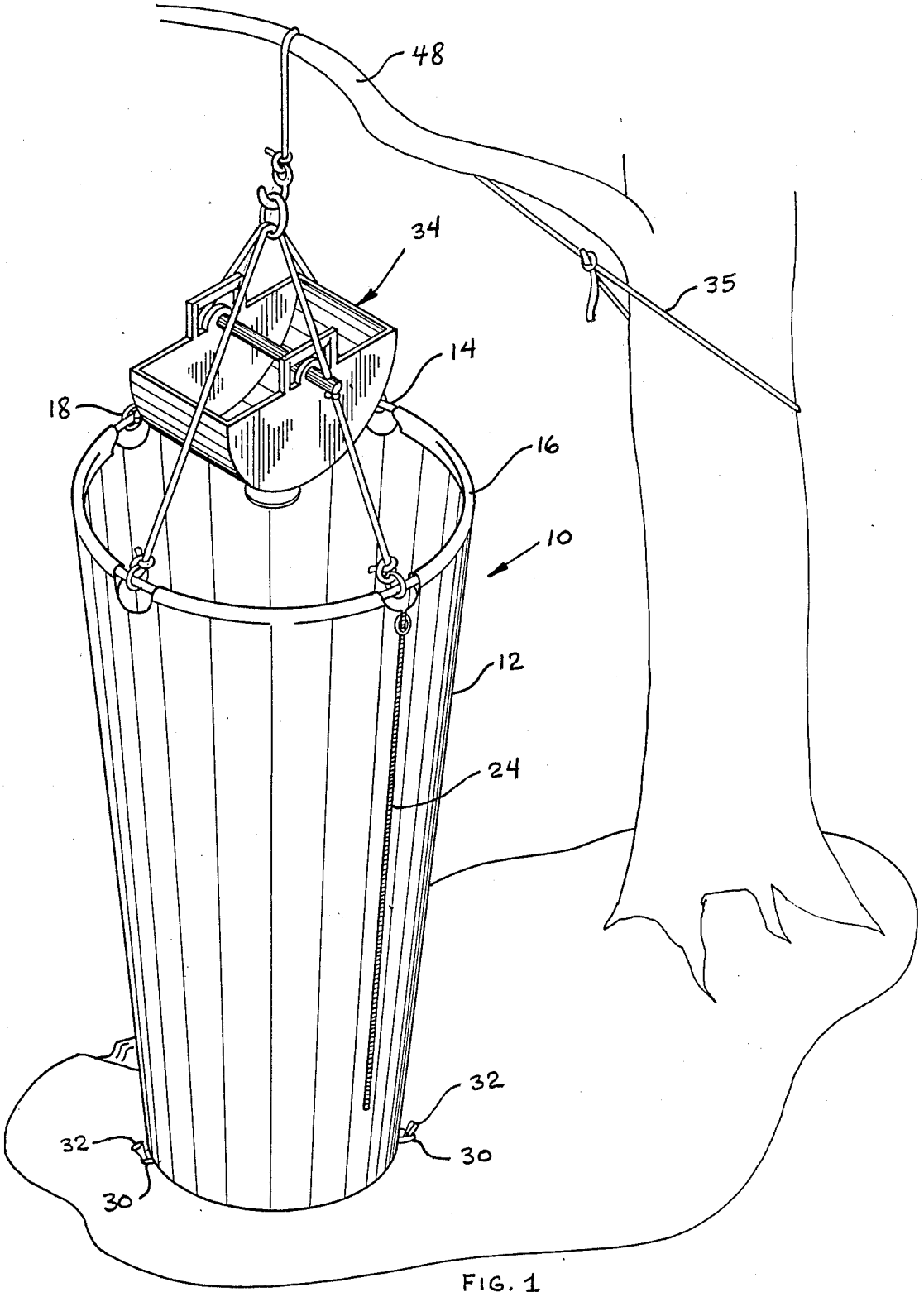
FIG. 1 is a perspective view of the portable shower assembly comprising the present invention.
Figure 2:
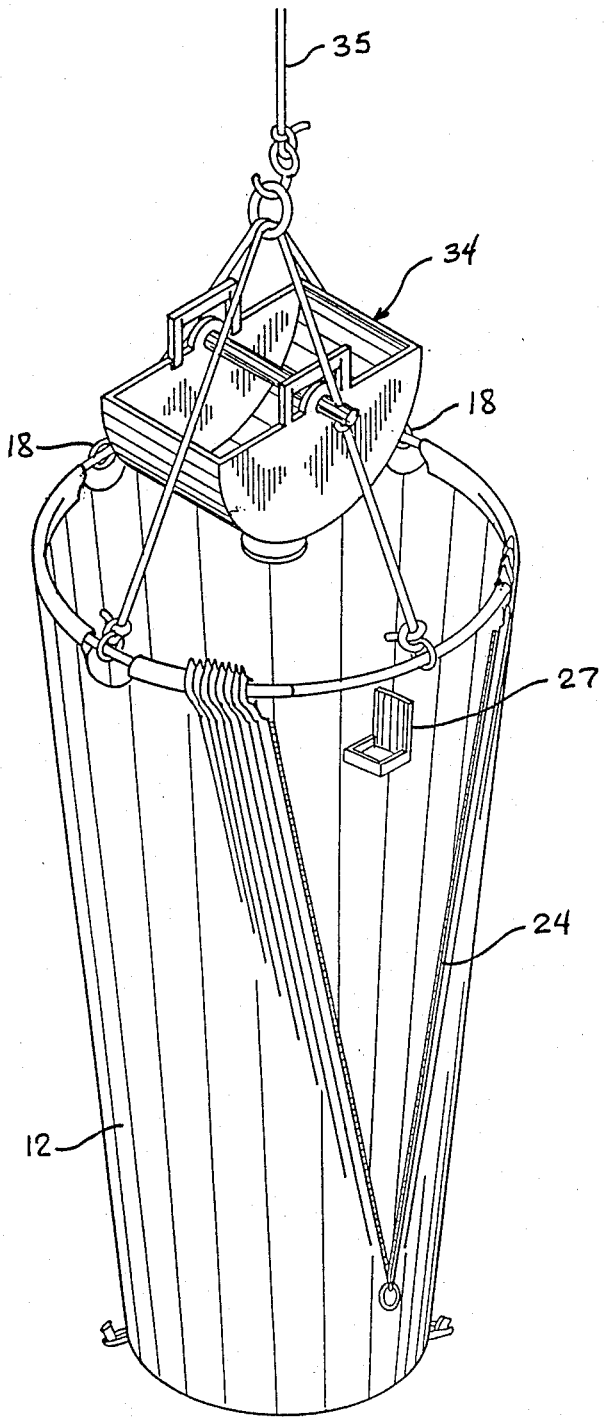
FIG. 2 is a perspective view of the invention in an open accessible position.

With reference now to the drawings, and in particular to FIGS. 1 and 2 thereof, a new and improved portable shower embodying the principles and concepts of the present invention and generally designated by the reference numeral 10 will be described.

Figure 3:
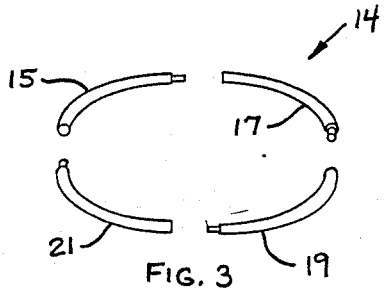
FIG. 3 is a perspective view of the shower curtain support forming a part of the present invention.
Figure 5:
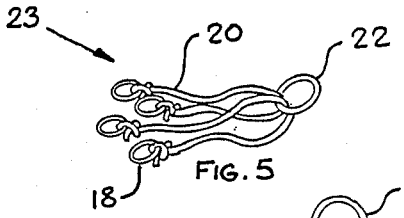
FIG. 5 is an end elevation view of the segment.
Figure 4:
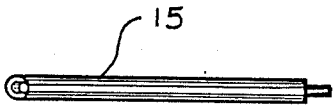
FIG. 4 is a top plan view of a curtain support segment.

More specifically, it will be noted that the portable shower 10 includes a cylindrically shaped flexible curtain 12 which is retained on a support ring 14 and which is of a wider diameter at the top than at the bottom. The funnel shape of the curtain 12 enhances water drainage while also providing a more compact and storable construction. The support ring 14 is positioned within a sleeve 16 formed on a top portion of the curtain 12. To facilitate the assembly and disassembly of the support ring 14 and as best illustrated in FIGS. 3, 4 and 5, the same is manufactured in four separable sections 15, 17, 19, 21 representing four substantially equal length arcs which, when combined, complete the circular construction of the ring. Each arced section can be inserted within the sleeve 16 through appropriate openings provided therein.

As further illustrated in FIGS. 1 and 2, a plurality of circular metallic rings 18 are attached to the shower curtain 12 with the aforementioned support ring 14 being positioned through the rings. The rings form a part of a suspension harness 23 as shown in FIG. 5 and have a plurality of flexible support lines 20 attached thereto. The support lines 20 all extend upwardly into an apex where they are joined together by a further support ring 22.

Figure 6:
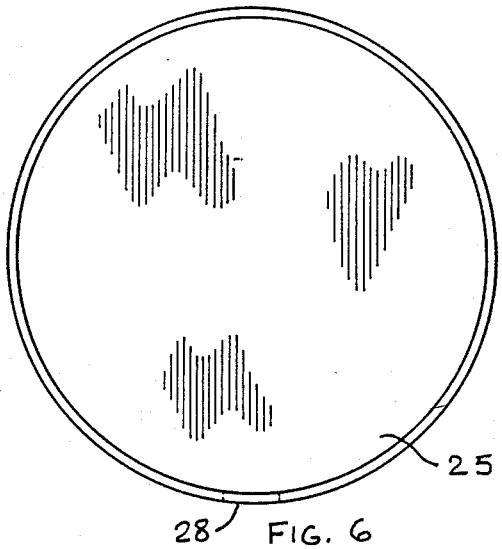
FIG. 6 is a top plan view of the floor portion of the shower.
Figure 7:
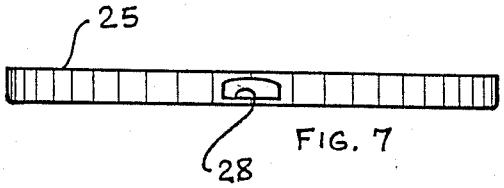
FIG. 7 is an end elevation view of the floor portion.

Also illustrated in FIGS. 1 and 2 is a zippered door 24 which facilitates access into and out of the suspended curtain 12, and as shown in FIGS. 6 and 7, a bottom portion of the curtain is attached to a flexible, non-skid, reinforced floor 25 on which a user of the shower stands. A small drainage aperture 28 may be provided at the periphery of the floor 25 to allow drainage of water from within the shower curtain 12. Typically, the drain aperture 28 would be three inches wide and would be aligned with an excavated trench to carry water away from the shower and campsite.

At least two additional rings 30 may be attached to a bottom portion of the curtain 12. These rings 30 facilitate the use of stakes 32 which permit the curtain 12 to be anchored to a ground surface in a conventional manner.

Figure 11:
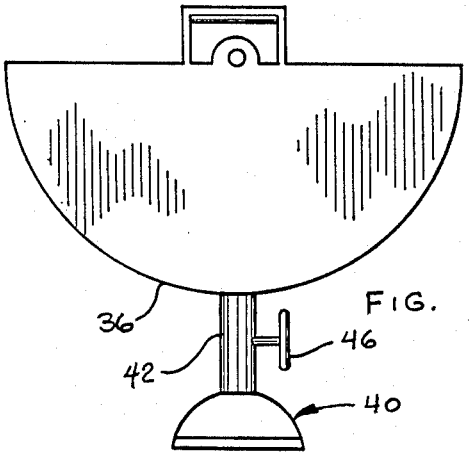
FIG. 11 is a front elevation view of the container.
Figure 10:
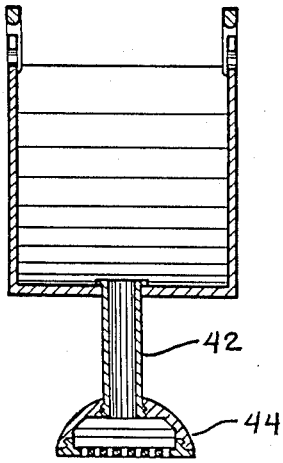
FIG. 10 is a cross-sectional view of the container as viewed along the line 10—10 in FIG. 9.
Figure 12:
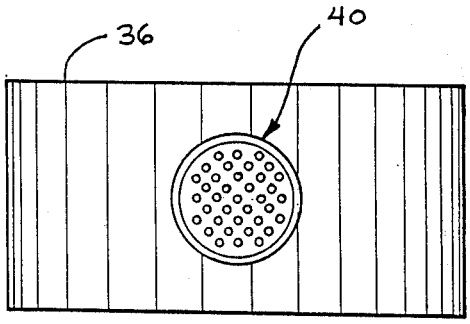
FIG. 12 is a bottom plan view of the container.

The construction of a water support and delivery container 34 is illustrated in FIGS. 1, 2 and 8–14. As illustrated, the container assembly 34 essentially comprises a semicircular housing 36 having a removable metallic handle 38 extending across a top open portion thereof. As best illustrated in FIGS. 10–12, the bottom of the housing 36 includes a shower head assembly 40. The shower head assembly 40 includes a water delivery conduit 42, a shower dispensing spray nozzle 44, and a conventional water supply shutoff valve 46. The shower head assembly 40 is illustrated as being fixedly secured to a bottom portion of the housing 36; however, it is to be understood that such assembly could be removably attachable thereto if desired. Further, the illustrated rigid water delivery conduit 42 could also be of a flexible hose design and of a greater length so as to allow a user of the shower 10 to manually hold and control the shower head spray nozzle 44 in a now apparent manner.

Figure 16:
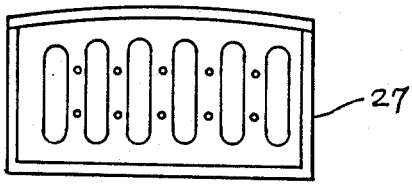
FIG. 16 is a top plan view of the soap dish.
Figure 17:
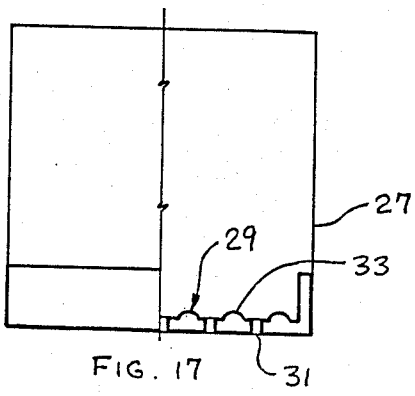
Fig. 17 is a front elevation view of the soap dish.
Figure 15:
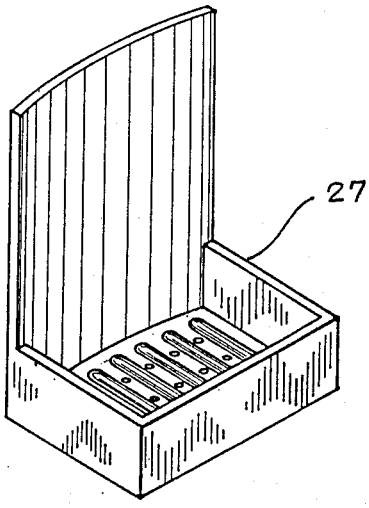
FIG. 15 is a perspective view of the soap dish forming a part of the invention.
Figure 9:
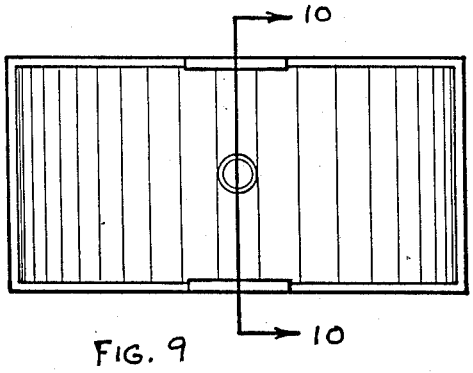
FIG. 9 is a top plan view of the storage container.
Figure 8:
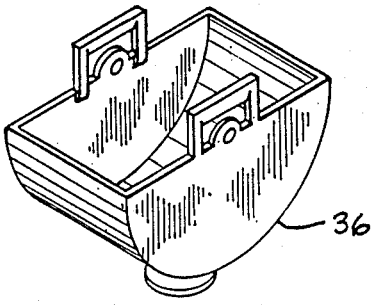
FIG. 8 is a perspective view of the storage container forming a part of the invention.

FIGS. 15, 16 and 17 illustrate a removable soap and shampoo holding tray 27 which may be attached to an inside wall surface of the flexible curtain 12 as best illustrated in FIG. 2. A floor portion 29 of the tray 27 includes a plurality of through-extending apertures 31 which facilitate water drainage from the tray. Additionally, upstanding ribs 33 support soap above the floor surface 29 so as to further lessen the likelihood of premature soap disintegration. The tray 27 may be retained within a provided pocket on an interior surface of the curtain 12 or alternatively, Velcro fastening means may be employed.

Figure 18:
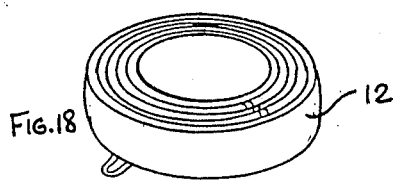
FIG. 18 is a perspective view of the harness forming a part of the invention.
Figure 19:
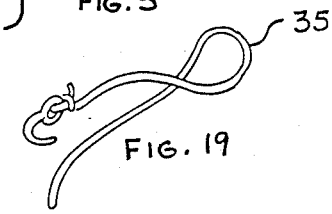
FIG. 19 is a perspective view of the shower support rope.
Figure 14:
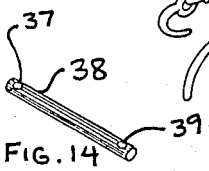
FIG. 14 is a perspective view of the support bar associated with the container.
Figure 13:
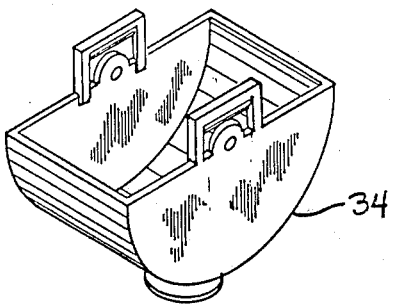
FIG. 13 is a further perspective view of the container.
Figure 5:
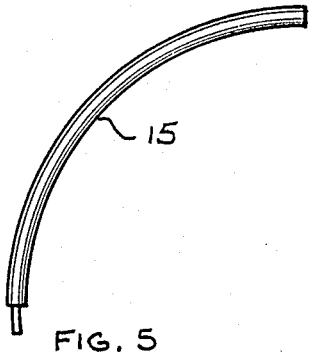

As to the manner of usage and operation of the present invention, a brief summary thereof will be provided. More specifically, it should be noted that the shower curtain 12 and its associated components would normally be retained within the container 34. In this regard, the container 34 functions both as a water holding and delivery device and as a storage container for the complete shower unit. This concept is illustrated when reference is made to FIGS. 3, 5, 13, 14, 18 and 19. In this regard, FIG. 18 illustrates the shower curtain 12 in a collapsed, folded position with the floor 25 still operably attached thereto. FIG. 19 illustrates a support string 35 which may be included with the kit to facilitate a use thereof. With the handle 38 removed, all of the components shown in FIGS. 3, 5, 14, 18 and 19 may be stored within the container 34. When the portable shower 10 is to be used, it is removed from the container 34 and suspended from a rigid support, such as a board or limb 48 attached to a tree or some other support structure. The length of flexible line 35 may then be utilized to hoist the shower curtain 12 upwardly in the manner best illustrated in FIG. 1. Once the shower curtain 12 has been anchored to the ground surface through the use of stakes 32, the harness 23 can be used to support the water carrying container 34 interiorly of the shower curtain by directing two of the flexible lines 20 through apertures 37, 39 located at opposed ends of the handle 38. With an appropriate supply of water in the container 34, a user thereof can commence to take a shower. Where the conduit 42 is of an extended length flexible design, the container 34 can be mounted exteriorly of the shower curtain 12 with only the hose being positioned interiorly thereof for the purposes of taking a shower. After the shower has been completed, the shower curtain 12 can again be collapsed for storage purposes.

With respect to the above descriptin then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved portable shower enclosure comprising:

flexible curtain means;

contour shaping means mounted in said curtain means for the purpose of maintaining said curtain means in a shower enclosure shape;

suspension means for holding said flexible curtain means in said shower enclosure shape;

and water container means for holding and selectively delivering a quantity of water into an interior portion of said shower enclosure, said water container means further functioning as a storage container means for said portable shower enclosure during periods of non-use, and wherein said flexible curtain means is substantially cylindrically shaped, and further including a zippered door formed in said flexible curtain means, and further including an integral flexible floor formed along a bottom portion of said flexible curtain means, said flexible curtain means including a plurality of securement rings at a lower terminal end of the cylindrically shaped curtain means each arranged to receive anchor stake therethrough to anchor the curtain means during use, and wherein said contour shaping means includes a rigid ring attached to a top portion of said flexible curtain means, said rigid ring being retained within a sleeve formed on said flexible curtain means, and wherein said rigid ring is formed in a plurality of separably arced sections, each of said sections being positionable within said sleeve during an assembly of said ring, and wherein said water container means includes a shower head assembly attached to a bottom portion thereof, and wherein said flexible curtain means is suspended from a pair of flexible lines having their ends attached to said ring and their mid portion suspended from an overhead support during use of said portable shower enclosure, and the water container further includes a handle member directed medially through opposed sides of the water container means and wherein the handle means includes a plurality of spaced apertures which lie external of said container to receive one of said pair of flexible liner therethrough to stabilize and orient the water container means relative to the flexible curtain means during use.

* * * * *